US011438702B2

(12) United States Patent
Nadella et al.

(10) Patent No.: US 11,438,702 B2
(45) Date of Patent: Sep. 6, 2022

(54) ACOUSTIC RECEIVERS WITH HINGED DIAPHRAGMS

(71) Applicant: Knowles Electronics, LLC, Itasca, IL (US)

(72) Inventors: Kalyan Nadella, Chicago, IL (US); Thomas Miller, Arlington Heights, IL (US); Shehab Albahri, Hanover Park, IL (US); Yahui Zhang, Schaumburg, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 17/134,314

(22) Filed: Dec. 26, 2020

(65) Prior Publication Data

US 2021/0204066 A1 Jul. 1, 2021

Related U.S. Application Data

(60) Provisional application No. 62/955,168, filed on Dec. 30, 2019.

(51) Int. Cl.
*H04R 11/02* (2006.01)
*H04R 1/10* (2006.01)

(52) U.S. Cl.
CPC ..... *H04R 11/02* (2013.01); *H04R 1/1066* (2013.01); *H04R 2460/11* (2013.01)

(58) Field of Classification Search
CPC .... H04R 11/02; H04R 1/1066; H04R 2460/11
See application file for complete search history.

(56) References Cited

U.S. PATENT DOCUMENTS

| | | | |
|---|---|---|---|
| 1,579,595 | A | 3/1926 | Frantz |
| 2,081,619 | A | 5/1937 | Ebert |
| 6,563,933 | B1 | 5/2003 | Niederdraenk |
| 6,931,140 | B2 | 8/2005 | van Halteren |
| 7,103,196 | B2 | 9/2006 | Warren |
| 7,194,102 | B2 | 3/2007 | Harvey |
| 7,203,334 | B2 | 4/2007 | Schafer et al. |
| 7,302,748 | B2 | 12/2007 | Jiles et al. |
| 7,336,797 | B2 | 2/2008 | Thompson et al. |
| 7,415,125 | B2 | 8/2008 | Warren et al. |
| 7,577,269 | B2 | 8/2009 | Adelman |
| 7,860,264 | B2 | 12/2010 | Jiles et al. |

(Continued)

FOREIGN PATENT DOCUMENTS

| | | |
|---|---|---|
| CN | 204291354 | 4/2015 |
| CN | 204350282 | 5/2015 |

(Continued)

*Primary Examiner* — Sunita Joshi

(57) ABSTRACT

Sound-producing acoustic receivers are disclosed. The acoustic receiver includes a housing, a first diaphragm, and a motor. The housing has an internal volume separated by the first diaphragm into a first front volume and a first back volume such that the first front volume has a first sound outlet. The first diaphragm includes a first paddle movable about a first hinge. The motor is disposed in the housing and includes an armature mechanically coupled to the first paddle. The first hinge is located between opposite ends of the first paddle such that actuation of the armature pivots both ends of the first paddle about the hinge.

20 Claims, 9 Drawing Sheets

(56) References Cited

U.S. PATENT DOCUMENTS

| | | | | |
|---|---|---|---|---|
| 7,912,240 | B2 | 3/2011 | Madaffari et al. | |
| 9,137,605 | B2 | 9/2015 | Manley et al. | |
| 9,571,941 | B2 | 2/2017 | Heidenreich et al. | |
| 10,009,693 | B2 | 6/2018 | van Halteren et al. | |
| 2013/0284537 | A1 | 10/2013 | LoPresti et al. | |
| 2015/0373456 | A1* | 12/2015 | Dayton | H04R 7/18 381/398 |
| 2019/0342666 | A1 | 11/2019 | Dayton et al. | |

FOREIGN PATENT DOCUMENTS

| | | | | | |
|---|---|---|---|---|---|
| CN | 204350283 | | | 5/2015 | |
| CN | 204350285 | | | 5/2015 | |
| CN | 204350286 | | | 5/2015 | |
| CN | 204350286 | U | * | 5/2015 | |
| CN | 205830004 | U | | 12/2016 | |
| CN | 107222810 | A | | 9/2017 | |
| CN | 107222810 | B | * | 11/2019 | H04R 7/02 |
| WO | 2018148485 | A1 | | 8/2018 | |

* cited by examiner

ACOUSTIC RECEIVERS WITH HINGED DIAPHRAGMS

RELATED APPLICATIONS

This application claims priority to U.S. Provisional Patent Application Ser. No. 62/955,168 filed on Dec. 30, 2019, entitled "Acoustic Receivers With Hinged Diaphragms," the entire contents of which are hereby incorporated by reference.

TECHNICAL FIELD

This disclosure relates generally to acoustic devices and more specifically to balanced armature acoustic receivers with a plurality of diaphragms.

BACKGROUND

Acoustic devices including balanced armature receivers that convert an electrical input signal to an acoustic output signal characterized by a varying sound pressure level (SPL) are generally known. Such acoustic devices may be embodied in hearing aids, headsets, hearables, or ear buds worn by a user. The receiver generally includes a motor and a coil to which an electrical excitation signal is applied. The coil is disposed about a portion of an armature (also known as a reed), a movable portion of which is disposed in equipoise between magnets, which are typically retained by a yoke. Application of the excitation or input signal to the receiver coil modulates the magnetic field, causing deflection of the reed between the magnets. The deflecting reed is linked to a movable portion of a diaphragm disposed within a partially enclosed receiver housing, wherein movement of the paddle forces air through a sound outlet or port of the housing. There is a need for balanced armature receivers to increase the volume displacement of the diaphragm and to increase the efficiency of the receivers.

BRIEF DESCRIPTION OF THE DRAWINGS

The objects, features, and advantages of the present disclosure will be more apparent to those of ordinary skill in the art upon consideration of the following Detailed Description with reference to the accompanying drawings.

Figure 1:
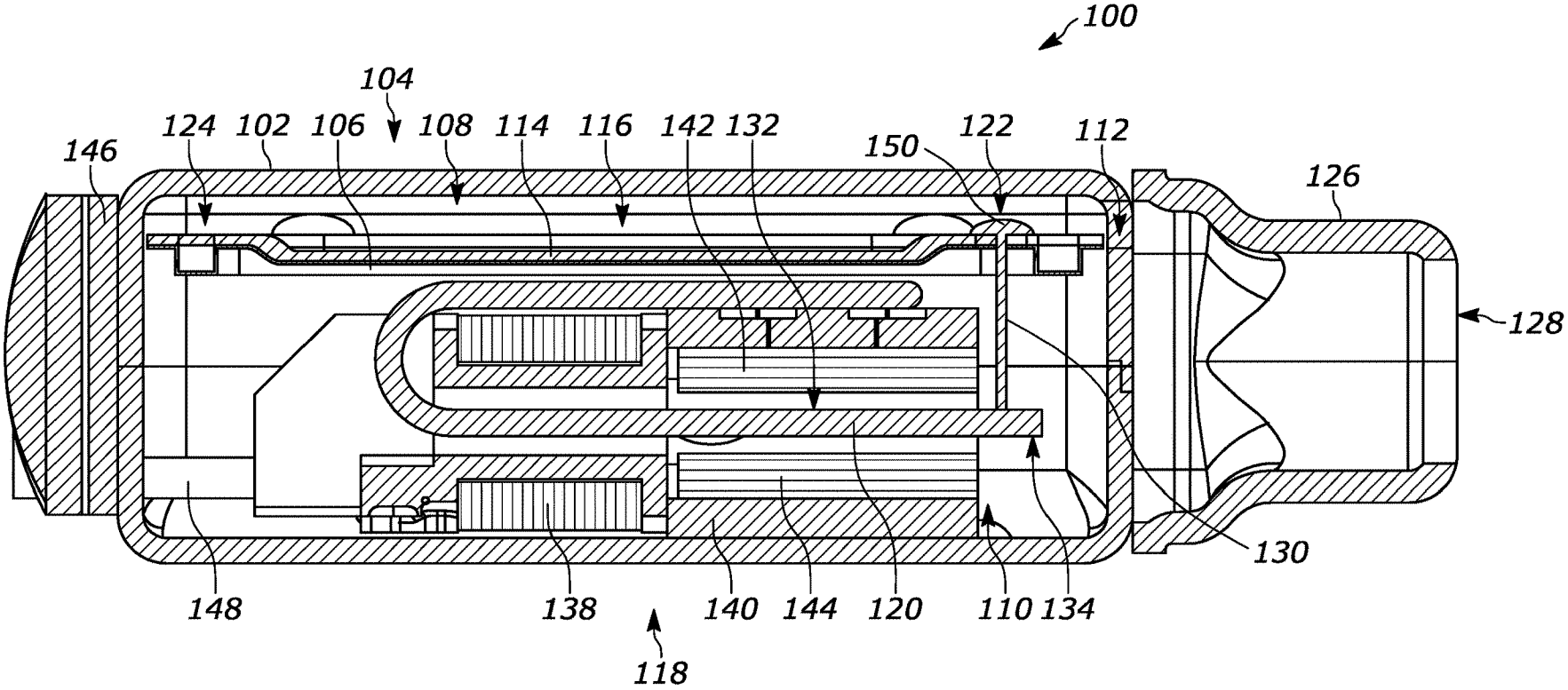
FIG. 1 illustrates a cross-sectional view of an acoustic receiver according to an embodiment.

Those of ordinary skill in the art will appreciate that elements in the figures are illustrated for simplicity and clarity. It will be further appreciated that certain actions or steps may be described or depicted in a particular order of occurrence while those of ordinary skill in the art will understand that such specificity with respect to sequence is not actually required unless a particular order is specifically indicated. It will also be understood that the terms and expressions used herein have the ordinary meaning as is accorded to such terms and expressions with respect to their corresponding respective fields of inquiry and study except where specific meanings have otherwise been set forth herein.

DETAILED DESCRIPTION

The present disclosure pertains to sound-producing acoustic devices (also referred to herein as "receivers"). The acoustic device may be embodied in a hearing aid or other hearing device, such as a behind-the-ear (BTE) device with a portion that extends into or on the ear, an in-the-canal (ITC) or partially in the ear canal device, a receiver-in-canal (RIC) device, a headset, a wired or wireless in-the-ear (ITE) earbud or earpiece, or as some other device that produces an acoustic output signal in response to an electrical input signal and is intended for use on, in, or in close proximity to a user's ear.

The receiver is configured in one of numerous different implementations generally comprising a housing containing one or more diaphragms and a motor. In one implementation, the housing has an internal volume that is separated by the first diaphragm into a first front volume and a first back volume such that the first front volume has a first sound outlet. The first diaphragm includes a first paddle movable about a first hinge. The motor is disposed in the housing and includes an armature mechanically coupled to the first paddle. The first hinge is located between opposite ends of the first paddle such that actuation of the armature pivots both ends of the first paddle about the hinge. In some embodiments, the first hinge is located closer to one end of the first paddle than the other end thereof, such that a majority of the first paddle moves in a direction opposite to force applied to the first paddle by the armature.

In one implementation, the receiver additionally has a second diaphragm that defines a second front volume in the internal volume. The second front volume has a second sound outlet, and the second diaphragm includes a second paddle movable relative to a second hinge. The armature is mechanically coupled to the second paddle such that a majority of the second paddle moves in a same direction as force applied to the second paddle by the armature. In some embodiments, the first hinge is a torsional hinge and the second hinge is a cantilever hinge. In some embodiments, the first front volume and the second front volume are on opposite sides of the first back volume such that the first back volume is located between the first front volume and the second front volume, and the first sound outlet is separate from the second sound outlet.

In some embodiments, the receiver includes a wall portion disposed in the housing that at least partially separates the first back volume from a second back volume. The motor is disposed on the wall portion, and the second diaphragm separates the second back volume from the second front volume. In some embodiments, the second back volume is acoustically coupled to the first back volume via an opening in the wall portion and/or the second back volume is vented to an exterior of the housing.

In some embodiments, the receiver includes a nozzle coupled to the housing. The nozzle has a sound port acoustically coupled to the first sound outlet and the second sound outlet, such that the first diaphragm and the second diaphragm collectively emit acoustic signals from the sound port in response to actuation of the armature. In some other embodiments further to the aforementioned implementation, the first paddle is mechanically coupled to the armature by a first link extending from a first side of the armature, and the second paddle is coupled to the armature by a second link extending from a second side of the armature opposite the first side thereof. Additionally, the armature includes an end portion such that the first link and the second link extend from opposites sides of the end portion.

In one example of this implementation, the receiver has a first diaphragm and a second diaphragm collectively separating the internal volume into a first front volume, a second front volume, and a back volume therebetween. The first paddle moves relative to a torsional hinge, and the second paddle moves relative to a cantilever hinge. The torsional hinge is positioned such that a majority of the first paddle moves about the torsional hinge in a direction opposite a force applied to the first paddle by the armature, and the cantilever hinge is positioned such that a majority of the second paddle moves in a same direction as the force applied to the second paddle by the armature. The first paddle has a sound emitting portion and a driving portion defined by the position of the torsional hinge, and the sound emitting portion has a larger surface area than the driving portion, which is where the armature applies the force on the first paddle.

In another implementation, the receiver additionally has a second diaphragm located between the first diaphragm and the motor. The second diaphragm forms a boundary between the first back volume and the first front volume, such that the first front volume is located between the first diaphragm and the second diaphragm. The second diaphragm includes a second paddle movable relative to a second hinge, and the armature is mechanically coupled to the second paddle such that a majority of the second paddle moves in a same direction as force applied to the second paddle by the armature.

In some embodiments, the second diaphragm is located between the first front volume and a second back volume such that the first front volume is located between the first back volume and the second back volume. Furthermore, the second back volume is vented to an exterior of the housing. The first diaphragm and the second diaphragm also collectively emit acoustic signals from the first sound outlet in response to actuation of the armature. In some embodiments, the first paddle and the second paddle are mechanically coupled to the armature by a link extending from a common side of the armature.

In one example of this implementation, the receiver has a first diaphragm and a second diaphragm collectively separating the internal volume into a first back volume, a second back volume, and a front volume therebetween. The first diaphragm includes a first paddle movable relative to a torsional hinge, and the second diaphragm has a second paddle movable relative to a cantilever hinge.

Details regarding the receiver will be disclosed below, with embodiments provided as non-limiting examples of the different configurations and embodiments provided herein.

Figure 2A:
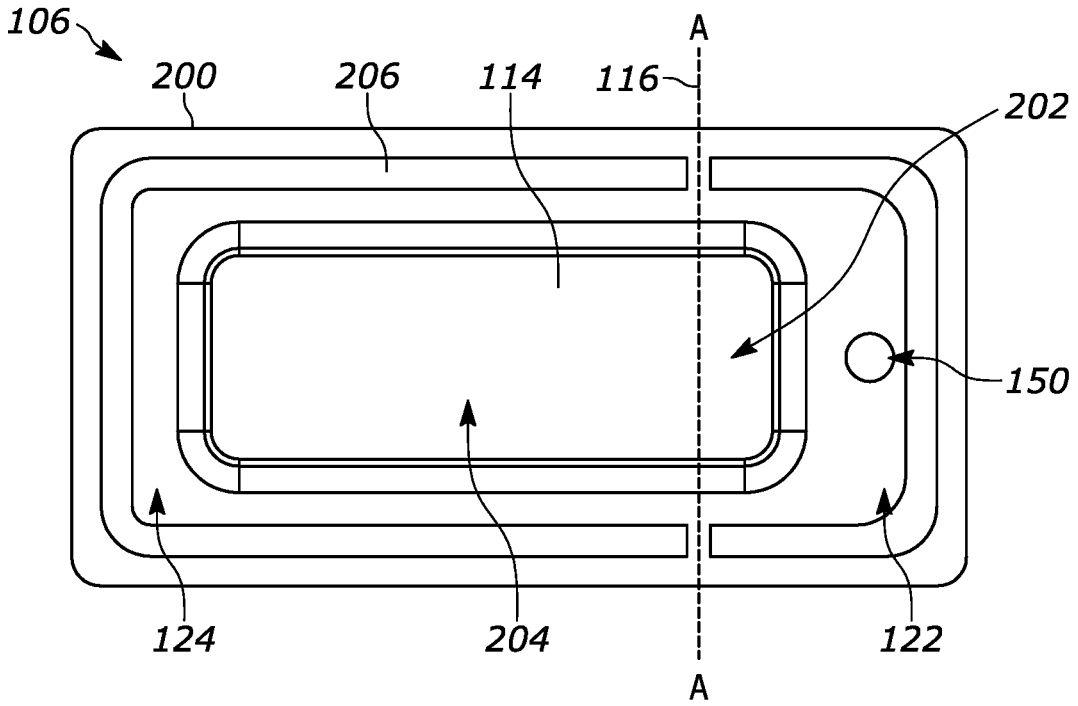
FIGS. 2A and 2B illustrate top and perspective views of a torsional diaphragm according to an embodiment.
Figure 2B:
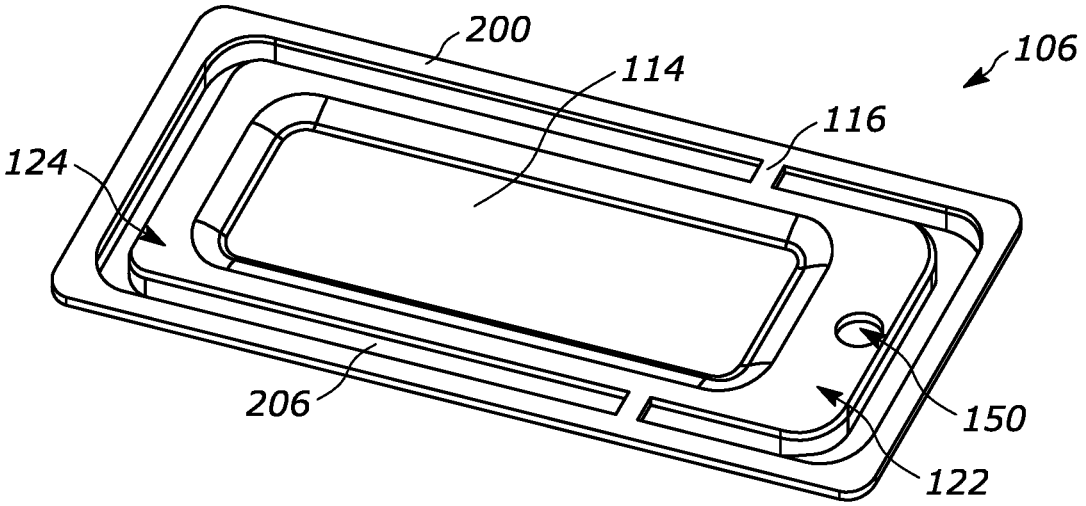

FIGS. 2A and 2B show an example of a frame 200, also referred to as a peripheral frame, having a paddle 114 located in an opening extending therethrough, as included in a balanced-armature receiver 100 as shown in FIGS. 1, 3, and 4A through 4C. The frame 200 includes a torsional hinge 116 which defines an axis (see line A-A in FIG. 2A for an example of such axis) about which the paddle 114 moves in response to a force applied to the paddle 114. The movement of the paddle 114 causes displacement in the diaphragm 106 that includes the paddle 114. Specifically, the paddle 114 has two opposing ends 122 and 124, where the first end 122 is located proximal to a coupling location 150 where the paddle 114 is to be coupled with a link 130 as further explained herein. The second end 124 is located distal from the coupling location 150 relative to the first end 122, and the torsional hinge 116 is located between these two ends 122, 124.

In some examples, the torsional hinge 116 is located closer to the first end 122 than the second end 124, or closer to the second end 124 than the first end 122, or in midway therebetween, equidistant from both ends 122, 124. When the hinge 116 is located closer to one end than the other, the paddle 114 is separated into two portions 202 and 204 based on where the hinge 116 (or the axis A-A) is located. The first portion 202 is defined as the portion between the first end 122 and the hinge 116, and the second portion 204 is defined as the portion between the second end 124 and the hinge 116. In some cases, the portion that includes the coupling location 150 may be referred to as a "driving portion," and the remaining portion may be referred to as a "sound emitting portion." Additionally, the diaphragm 106 also includes a flexible membrane 206 extending over and covering the gap between the paddle 114 and the frame 200. The flexible membrane 206 is constructed of any suitable material including but not limited to a plastic film such as urethane, Mylar, or silicone, for example. In some examples, a portion of the frame 200, the paddle 114, and the hinge 116 form an unassembled, single-piece of substantially planar material such as metal or plastic.

FIGS. 1, 3, and 4A to 4C show the balanced-armature receiver 100 that includes the diaphragm 106 as shown in FIGS. 2A and 2B, according to various embodiments. In the embodiments, the housing 102 of the receiver 100 defines an internal volume 104 which is separated into a front volume 108 and a back volume 110 by the diaphragm 106. The front volume 108 has a sound outlet 112 through which any acoustic signal created by the displacement of one or more diaphragms propagates. A motor or motor assembly 118 is located in the housing 102. The armature 120 of the motor assembly 118 is mechanically coupled to the paddle 114 via a link 130 at the coupling location 150, via any suitable attachment means including but not limited to gluing.

The motor assembly 118 of the receiver 100 includes, in addition to the armature 120 (also known as a reed), a bobbin 136, a coil 138, a yoke 140, and a pair of magnets 142, 144. In the embodiments shown, the motor assembly is disposed in a back volume. In other embodiments, however, the motor assembly may be located in a front volume or partially in the front or back volume. In some examples, a portion of the motor assembly is located in the back volume and the remaining portion of the motor assembly is located in the front volume. In some examples, the diaphragm is formed directly on the armature placing part of the motor into the front volume and part in the back volume. The yoke 140 holds the pair of magnets 142, 144 between which a portion of the armature 120 movably extends. The link 130 extends from a side 132 of the armature 120 at or near an end portion 134 or tip thereof. When the coil 138 is activated by applying an electrical signal thereto, a magnetic field is created in the motor assembly 118, causing the armature 120 to deflect relative to the magnets 142. The deflection of the armature 120 causes displacement in the paddle 114 at the coupling location 150, creating acoustic signals to be propagated from the front volume 108 through the sound outlet 112 and a sound port 128 of a nozzle 126 attached to the housing 102. The sound outlet 112 is acoustically coupled to the sound port 128.

A terminal pad 146, or any other suitable terminal coupling device, is attached to the housing 102 to electrically couple with the coil 138 via one or more wires 148. The terminal pad 146 may be coupled to other external circuitry such as a hearing aid, cellular phone, personal computer or tablet (to mention a few examples) to perform additional processing functions and receive power.

Figure 3:
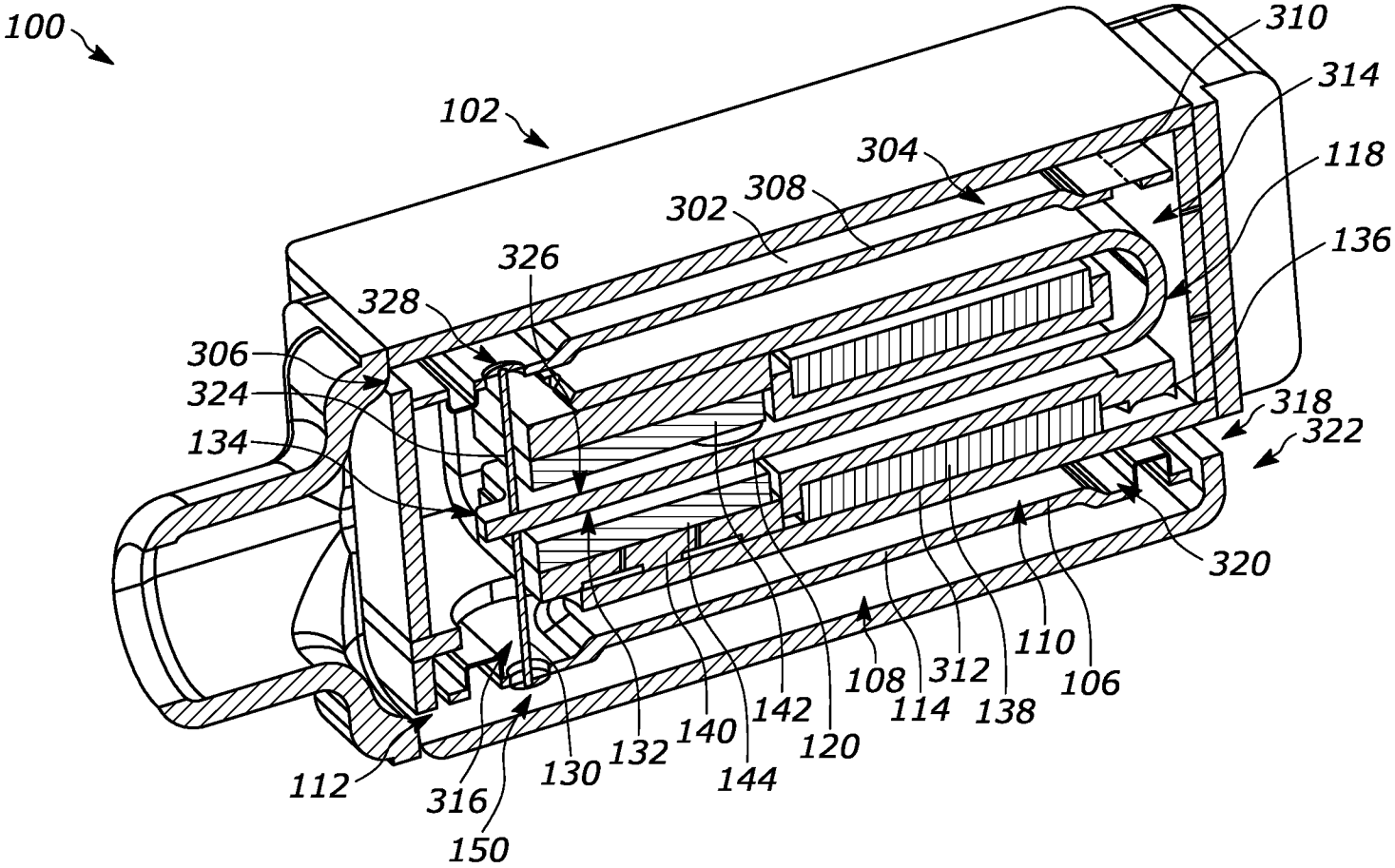
FIG. 3 illustrates a perspective view of a cross-section of an acoustic receiver according to an embodiment.

In FIG. 3, an additional diaphragm 302 is included in the receiver 100 such that the first diaphragm 106 and the second diaphragm 302 collectively separate the internal volume 104 into the first front volume 108, a second front volume 304 (which has its own sound outlet, i.e. a second sound outlet 306, that is separate from the first sound outlet 112), and the first back volume 110 located between the two front volumes 108, 304 such that the front volumes 108, 304 are on opposite sides of the first back volume 110. The second diaphragm 302 includes a second paddle 308, in addition to the first paddle 114, that is movable relative to a second hinge 310. The armature 120 is mechanically coupled to the second paddle 308 via a second link 324 such that a majority of the second paddle 308 moves in a same direction as force applied to the second paddle 308, such as at a coupling location 328, by the armature 120.

In some examples, the second hinge 310 is a cantilever hinge positioned on one end of the second paddle 308 such that, similar to a hinged door, the entire paddle moves in response to the force applied thereto. In some other examples, the second hinge 310 is another torsional hinge located such that a majority of the paddle 308 moves in the same direction as the applied force.

In FIG. 3, the receiver 100 includes a wall portion 312 on which the motor assembly 118 is disposed. The wall portion 312 separates the first back volume 110 from a second back volume 314, where the two back volumes 110 and 314 are acoustically coupled together via an opening 316 in the wall portion 312. The primary purpose of the opening 316 is to accommodate passage of the link 130. In FIG. 3, however, the opening 316 also allows for air flow between the two back volumes 110 and 314. The back volumes 110 and 314 are also coupled to a vent 318 located between an interior 320 of the second back volume 314 and an exterior 322 of the housing 102 to allow air to flow therethrough. Coupling the smaller back volume to the larger back volume and/or to an exterior of the housing improves performance of the receiver. Furthermore, the sound port 128 is acoustically coupled to both the first sound outlet 112 and the second sound outlet 306. The first diaphragm 106 and the second diaphragm 302 collectively emit acoustic signals from the sound port 128 in response to actuation of the armature 120.

Additionally, the first link 130 and the second link 324 extend from opposite sides of the armature 120. Specifically, the first link 130 extends from the first side 132 whereas the second link 324 extends from a second side 326 of the armature 120. The links 130, 324 extend from the armature 120 at or near the end portion 134 or tip thereof, which is where the deflection occurs in response to the activation of the motor assembly 118. The links 130, 324 can be discrete or separate parts coupled to corresponding sides of the armature, or a single part extending through the armature.

Figure 4A:
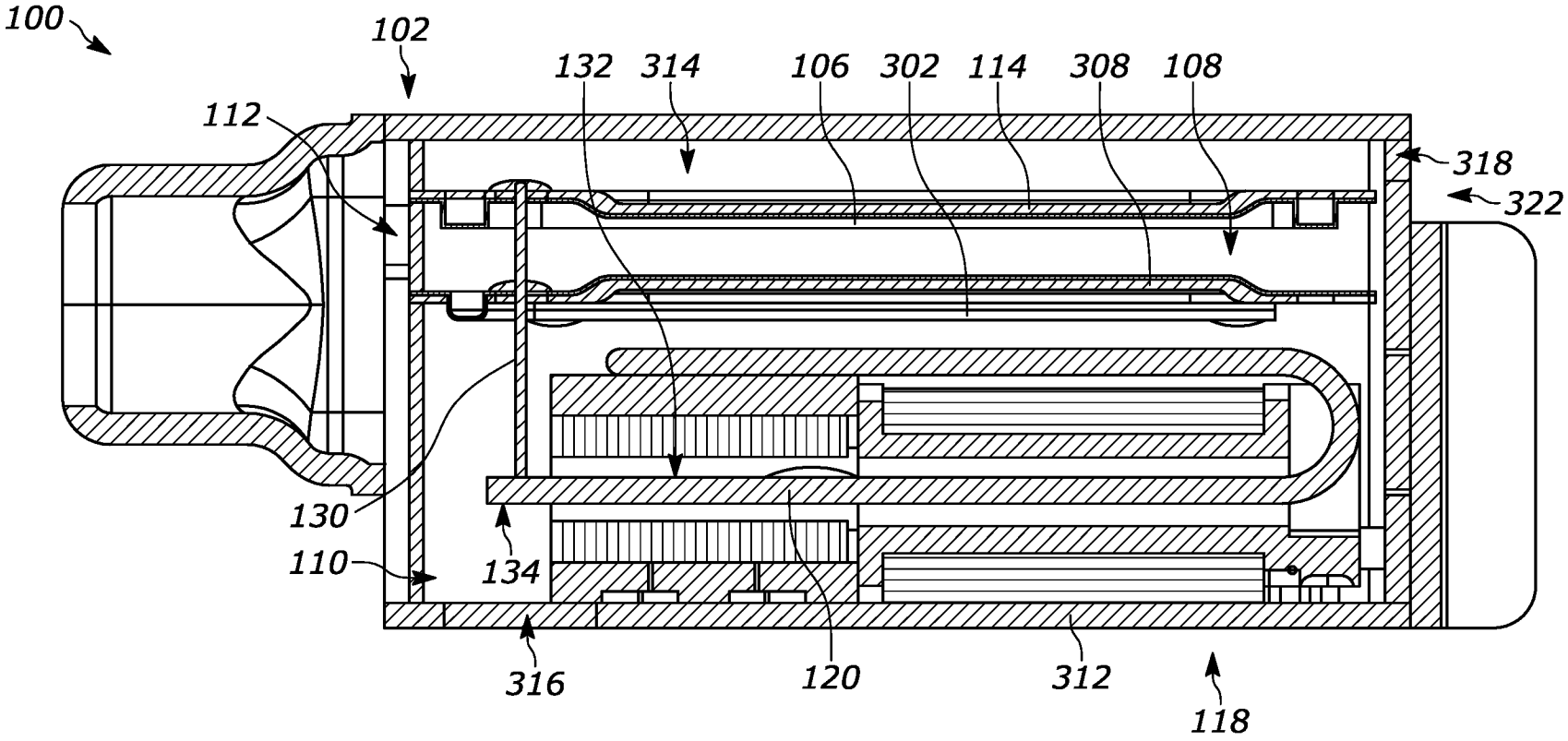
FIG. 4A illustrates a cross-sectional view of an acoustic receiver according to an embodiment.
Figure 4B:
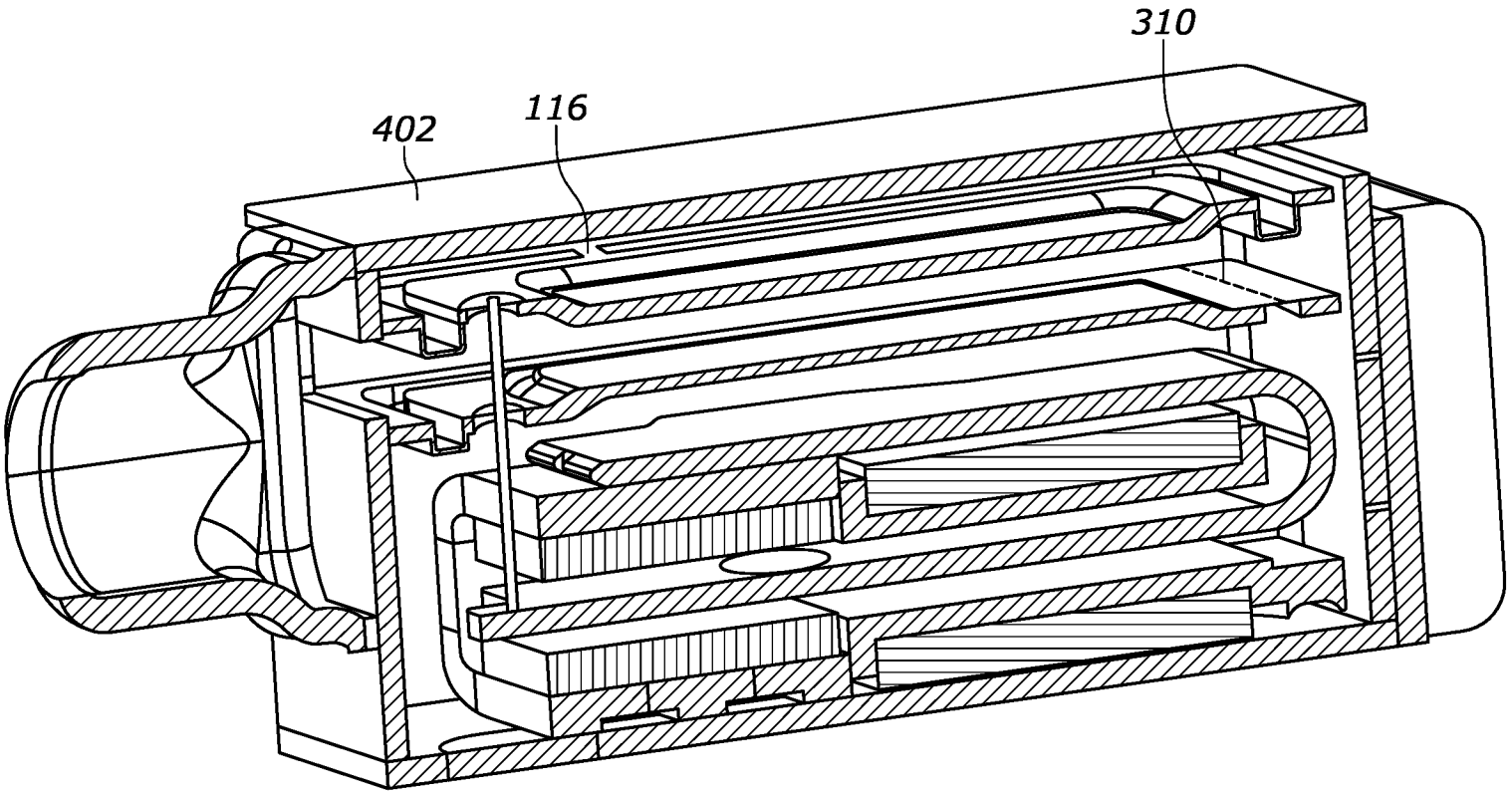
FIG. 4B illustrates a perspective view of the acoustic receiver shown in FIG. 4A.
Figure 4C:
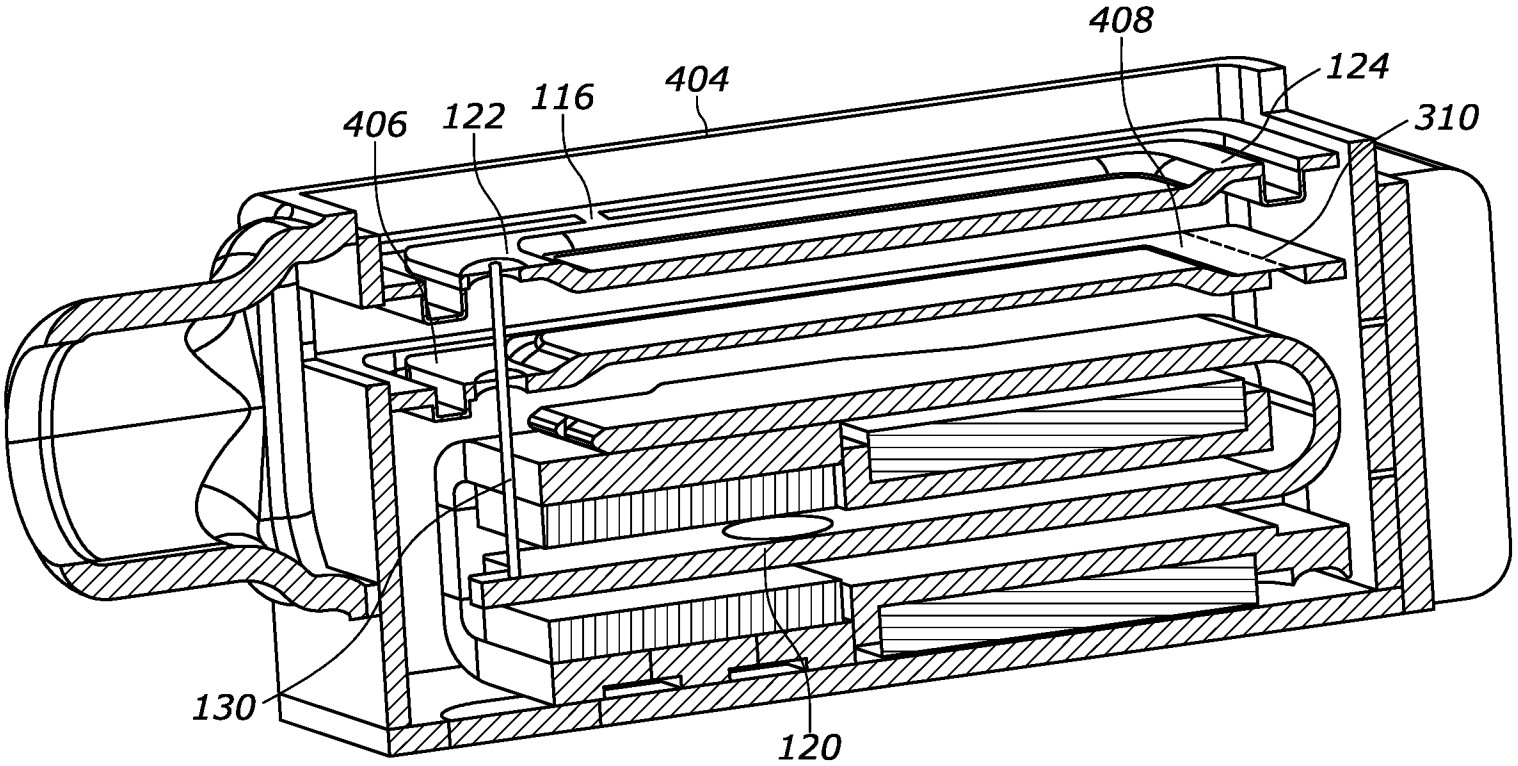
FIG. 4C illustrates a perspective view of the acoustic receiver shown in FIG. 4A without a top cover.

In FIGS. 4A to 4C, the second diaphragm 302 is included in the receiver 100 such that the first diaphragm 106 and the second diaphragm 302 collectively separate the internal volume 104 into the first back volume 110, the second back volume 314, and the first front volume 108 located between the two back volumes 110, 314 such that the back volumes 110, 314 are on opposite sides of the first front volume 108. The armature 120 is mechanically coupled to both the first paddle 114 and the second paddle 308 via the first link 130 that extends from the common side 132 of the armature 120. In some examples, the opening 316 provides ventilation for the first back volume 110 while the vent 318 provides ventilation for the second back volume 314 to the exterior 322 of the housing 102. The first diaphragm 106 and the second diaphragm 302 collectively emit acoustic signals from the first sound outlet 112 in response to actuation of the armature 120.

FIG. 4C shows the housing 102 without a top cover 402 which is attached to a sidewall 404 that forms the internal volume 104. Similar to the first paddle 114 which has the first end 122 and the second end 124, the second paddle 308 also has a first end 406 and a second end 408. The first end 406 of the second paddle 308 is located proximal to the second link 324 and the coupling location 328, whereas the second end 408 is located proximal to the second hinge 310, which in some examples is the cantilever hinge. The movement of the four identified ends (i.e., the first end 122 and the second end 124 of the first paddle 114 as well as the first end 406 and the second end 408 of the second paddle 308) in response to a movement in the armature 120 is further illustrated in FIGS. 5A to 5C.

Figure 5A:
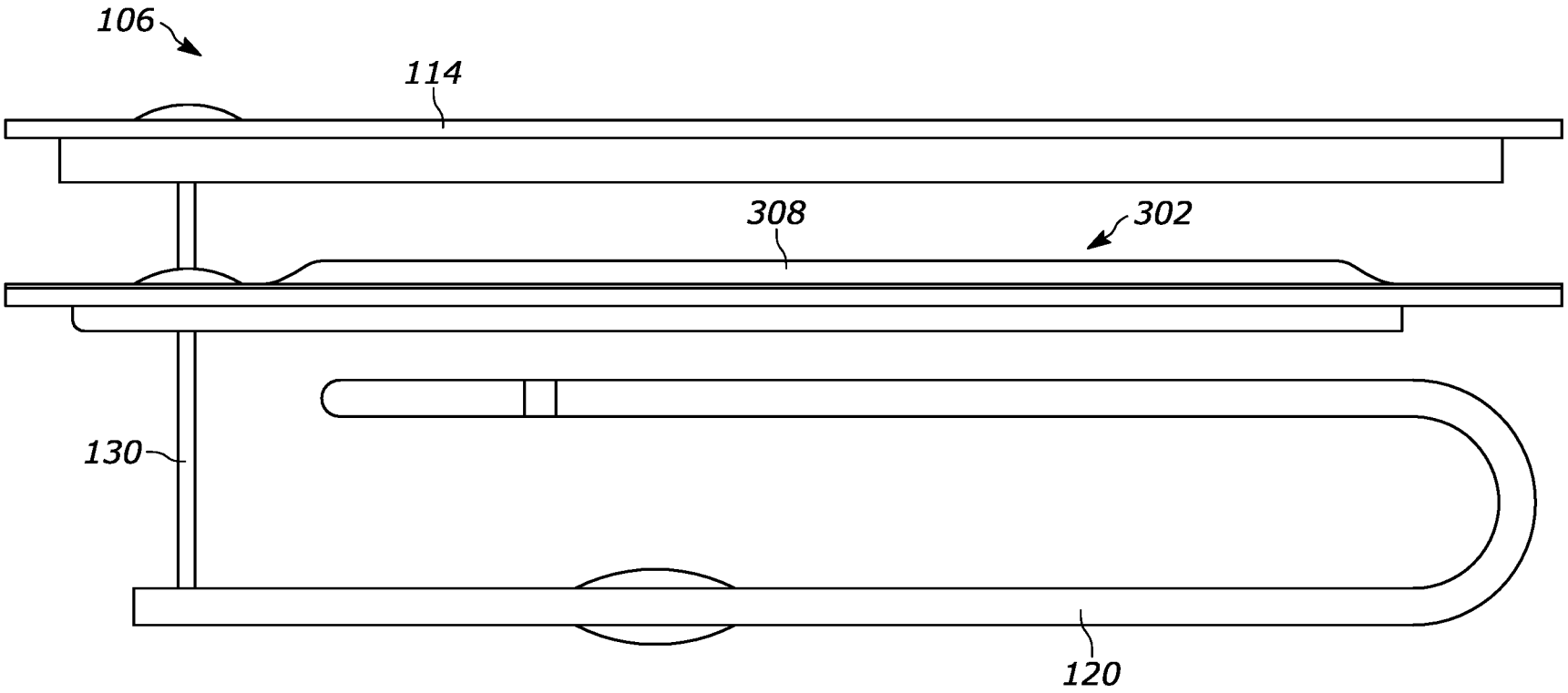
FIGS. 5A to 5C illustrate the different positions of the armature and the two paddles relative to each other as shown in FIG. 4A.

FIG. 5A illustrates the armature 120 in an inactive state, which is when the armature 120 is not displaced by the magnetic field formed by activating the coil. In this state, the first paddle 114 and the second paddle 308 are shown to be generally parallel to each other.

Figure 5B:
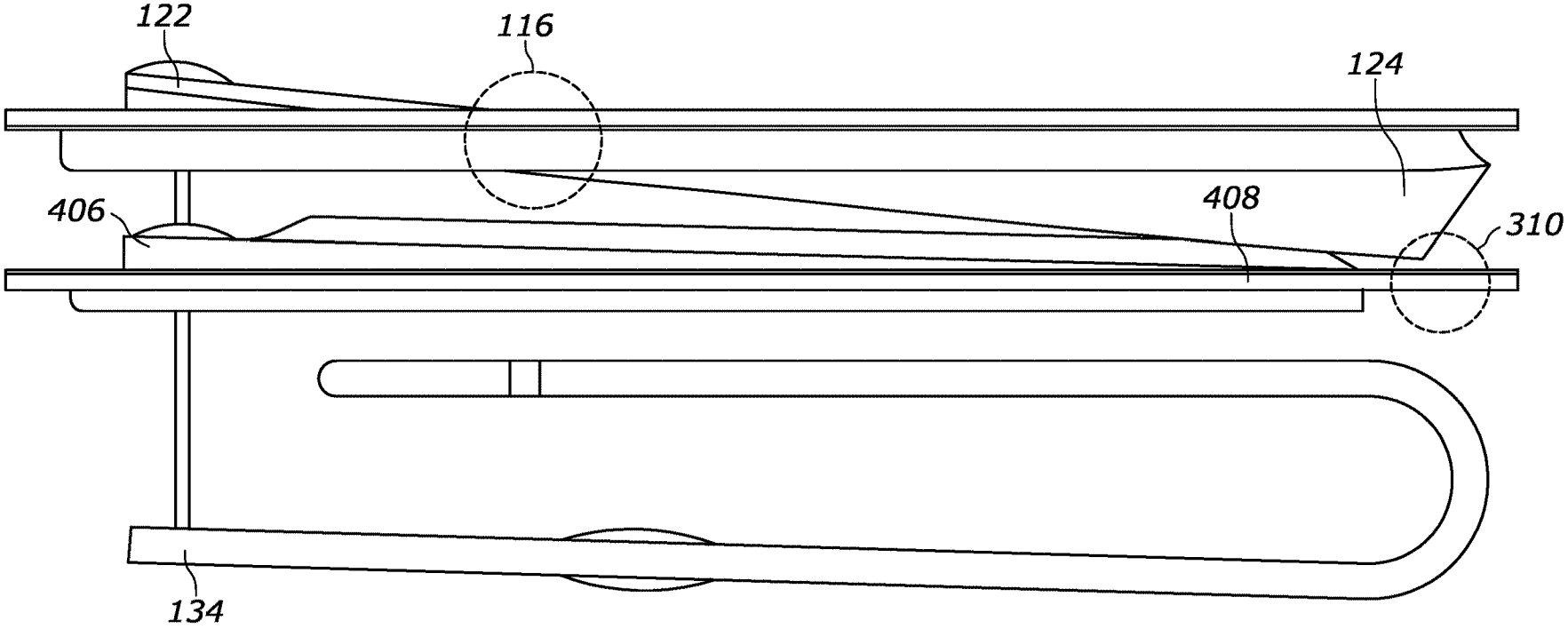

In FIG. 5B, the armature 120 is in a first active state in which the end portion 134 of the armature 120 is deflected upward, or toward the two paddles 114, 308. In response to this deflection, the first end 122 of the first paddle 114 and the first end 406 of the second paddle 308 are deflected upward, in the same direction as the force applied thereto. Because the second end 408 of the second paddle 308 is located at the second hinge 310, there is little to no displacement in the second end 408, but the second end 124 of the first paddle 114 is deflected downward, or in a direction opposite of the force applied to the first end 122. The deflection of the first and second paddles thus displaces more air than would be displaced if only one diaphragm is driven by the armature.

Figure 5C:
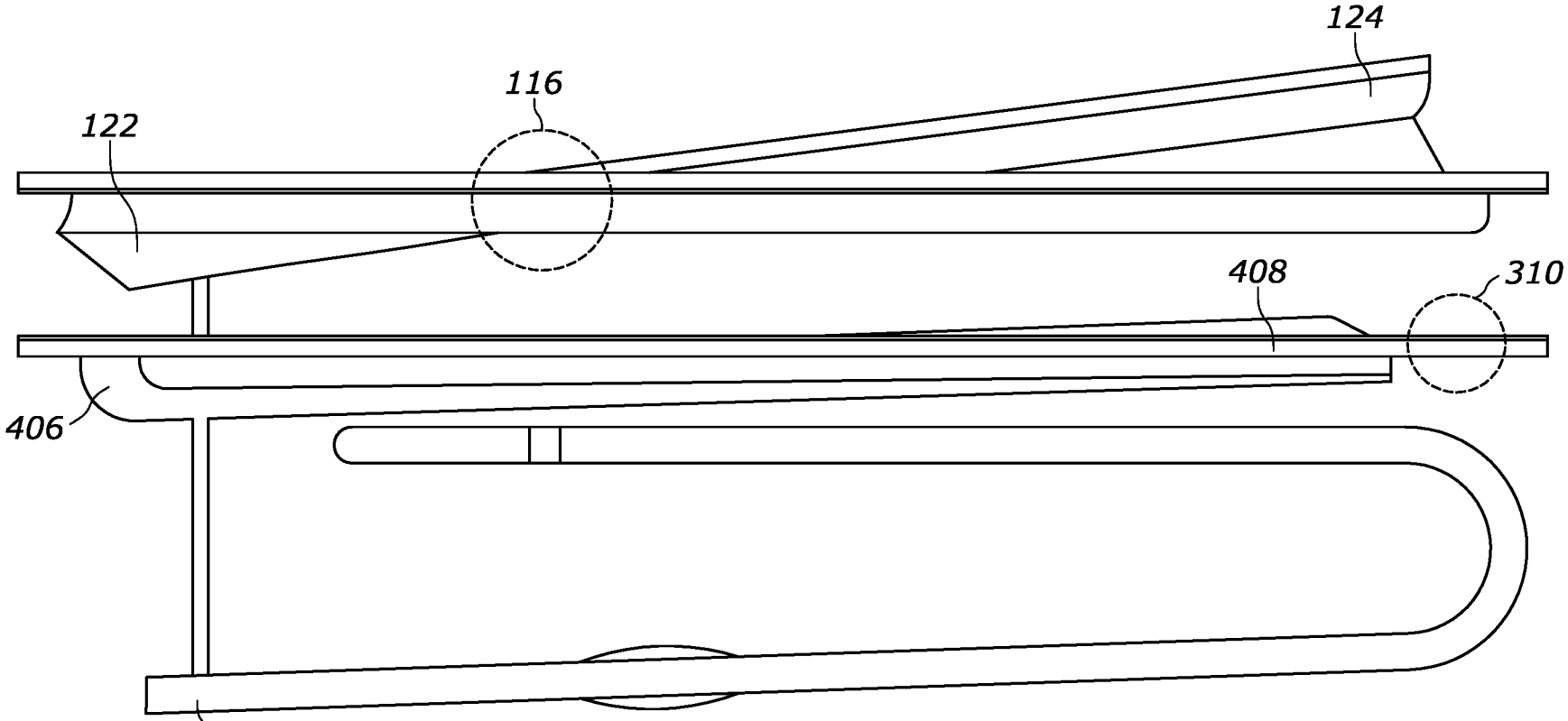

In FIG. 5C, the armature is in a second active state in which the end portion 134 of the armature 120 is deflected downward, or away from the two paddles 114, 308. In response to this deflection, the first end 122 of the first paddle 114 and the first end 406 of the second paddle 308 are deflected downward, in the same direction as the force applied thereto. Again, there is little to no displacement in the second end 408 of the second paddle 308, but the second end 124 of the first paddle 114 is deflected upward, or in a direction opposite of the force applied to the first end 122. Here too, the deflection of the first and second paddles displaces more air than would be displaced if only one diaphragm is driven by the armature.

In some examples, other combinations of cantilever and torsional hinged diaphragms can be implemented in addition to the embodiments disclosed above and in the figures. For example, the receiver 100 can include diaphragms with torsional hinges without including any diaphragm with a cantilever hinge, by adjusting the location of the torsional hinge along a length of the diaphragm to produce the desired acoustic response. In some examples, the locations of the diaphragms with the torsional and cantilever hinges can be swapped such that the locations of the first diaphragm 106 and the second diaphragm 302 are switched in any one of FIGS. 3, 4A to 4C, and 5A to 5C, for example. In some examples, more than two diaphragms can be coupled with the armature 120, and in such cases, the hinge on each diaphragm can be positioned at any location between the two ends of the diaphragm or at one end of the diaphragm, as suitable. Advantages in having two or more diaphragms include more flexible design in the receiver structure to control the acoustic pressure within any portion of the internal volume of the receiver housing. For example, having a plurality of diaphragms as disclosed herein can increase the acoustic pressure in the front volume(s) more than when only one diaphragm is used, in response to the same input signal from the terminal device. Changing the location of the hinges also controls how much the acoustic pressure can be increased in the front volume(s), without having to change the entire arrangement of the components within the receiver.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

What is claimed is:

1. A balanced armature receiver comprising:

a housing having an internal volume;

a first diaphragm separating the internal volume into a first front volume and a first back volume, the first front volume having a first sound outlet, the first diaphragm comprising a first paddle movable about a first hinge;

a motor disposed in the housing, the motor including an armature mechanically coupled to the first paddle, the first hinge located between opposite ends of the first paddle such that actuation of the armature pivots both ends of the first paddle about the hinge, the first hinge located closer to one end of the first paddle than the other end thereof, wherein a majority of the first paddle moves in a direction opposite to force applied to the first paddle by the armature.

2. The receiver of claim 1, further comprising a second diaphragm defining a second front volume in the internal volume, the second front volume having a second sound outlet, the second diaphragm comprising a second paddle movable relative to a second hinge, the armature mechanically coupled to the second paddle such that a majority of the second paddle moves in a same direction as force applied to the second paddle by the armature.

3. The receiver of claim 2, wherein the first hinge is a torsional hinge and the second hinge is a cantilever hinge.

4. The receiver of claim 2, wherein the first front volume and the second front volume are on opposite sides of the first back volume such that the first back volume is located between the first front volume and the second front volume, and the first sound outlet is separate from the second sound outlet.

5. The receiver of claim 4, further comprising a wall portion disposed in the housing and at least partially separating the first back volume from a second back volume, the motor disposed on the wall portion, and the second diaphragm separating the second back volume from the second front volume.

6. The receiver of claim 5, the first back front volume acoustically coupled to the second back volume via an opening in the wall portion.

7. The receiver of claim 5, the housing further comprising a vent between an interior of the second back volume and an exterior of the housing.

8. The receiver of claim 4 further comprising a nozzle coupled to the housing, the nozzle having a sound port acoustically coupled to the first sound outlet and the second sound outlet, wherein the first diaphragm and the second diaphragm collectively emit acoustic signals from the sound port in response to actuation of the armature.

9. The receiver of claim 2, the first paddle mechanically coupled to the armature by a first link extending from a first side of the armature and the second paddle coupled to the armature by a second link extending from a second side of the armature opposite the first side thereof.

10. The receiver of claim 9, the armature including an end portion, the first link and the second link extending from opposites sides of the end portion.

11. The receiver of claim 1 further comprising a second diaphragm located between the first diaphragm and the motor, the second diaphragm forming a boundary between the first back volume and the first front volume, wherein the first front volume is located between the first diaphragm and the second diaphragm, the second diaphragm comprising a second paddle movable relative to a second hinge, the armature mechanically coupled to the second paddle such that a majority of the second paddle moves in a same direction as force applied to the second paddle by the armature.

12. The receiver of claim 11, the second diaphragm located between the first front volume and a second back volume, wherein the first front volume is located between the first back volume and the second back volume.

13. The receiver of claim 12 wherein the second back volume is vented to an exterior of the housing.

14. The receiver of claim 12, wherein the first diaphragm and the second diaphragm collectively emit acoustic signals from the first sound outlet in response to actuation of the armature.

15. The receiver of claim 11, the first paddle and the second paddle mechanically coupled to the armature by a link extending from a common side of the armature.

16. The receiver of claim 12, the first hinge being a torsional hinge and the second hinge being a cantilever hinge.

17. A balanced armature receiver comprising:

a housing having an internal volume;

a first diaphragm and a second diaphragm collectively separating the internal volume into a first front volume, a second front volume, and back volume therebetween, the first diaphragm comprising a first paddle movable relative to a torsional hinge and the second diaphragm comprising a second paddle movable relative to a cantilever hinge;

a motor disposed in the housing, the motor including an armature operatively coupled to the first paddle and to the second paddle, the torsional hinge positioned such that a majority of the first paddle moves about the torsional hinge in a direction opposite a force applied to the first paddle by the armature, and the cantilever hinge positioned such that a majority of the second paddle moves in a same direction as the force applied to the second paddle by the armature.

18. The receiver of claim 17, the first paddle comprising a sound emitting portion and a driving portion defined by the position of the torsional hinge, the sound emitting portion having a larger surface area than the driving portion, wherein the armature applies the force to the driving portion of the first paddle.

19. A balanced armature receiver comprising:

a housing having an internal volume;

a first diaphragm and a second diaphragm collectively separating the internal volume into a first back volume, a second back volume, and a front volume therebetween, the first diaphragm comprising a first paddle movable relative to a torsional hinge and the second diaphragm comprising a second paddle movable relative to a cantilever hinge;

a motor disposed in the housing or the second back volume, the motor including an armature operatively coupled to the first diaphragm and to the second diaphragm, the torsional hinge positioned such that a majority of the first paddle moves about the torsional hinge in a direction opposite a force applied to the first paddle by the armature, and the cantilever hinge positioned such that a majority of the second paddle moves in a same direction as the force applied to the second paddle by the armature.

20. The receiver of claim 19, the first paddle comprising a sound emitting portion and a driving portion defined by the position of the torsional hinge, the sound emitting portion having a larger surface area than the driving portion, wherein the armature applies the force to the driving portion of the first paddle.

* * * * *